US005199813A

United States Patent [19]

Nagler

[11] Patent Number: 5,199,813

[45] Date of Patent: Apr. 6, 1993

[54] WEIGHTS FOR ROAD MARKERS

[76] Inventor: Yaacov Nagler, 7300 Pyle Rd., Bethesda, Md. 20817

[21] Appl. No.: 876,451

[22] Filed: Apr. 30, 1992

[51] Int. Cl.[5] ..... E01F 9/00

[52] U.S. Cl. ..... 404/9; 404/10

[58] Field of Search ..... 404/9, 10; 116/63 R, 116/63 P, 63 C; 256/64

[56] References Cited

U.S. PATENT DOCUMENTS

| | | | |
|---|---|---|---|
| 2,719,505 | 10/1955 | Blumenthal | 404/9 X |
| 3,099,244 | 7/1963 | Knapp . | |
| 3,451,368 | 6/1969 | Keats | 404/9 X |
| 3,621,611 | 11/1971 | Wingerter | 47/34 |
| 3,692,281 | 9/1972 | Clayton | 256/64 |
| 4,021,020 | 5/1977 | Decker | 256/1 |
| 4,925,334 | 5/1990 | Beard | 404/9 |
| 5,050,342 | 9/1991 | Figueroa | 47/66 |

FOREIGN PATENT DOCUMENTS

| | | | |
|---|---|---|---|
| 2615541 | 11/1988 | France | 404/9 |

*Primary Examiner*—Thuy M. Bui

*Attorney, Agent, or Firm*—Brady, O'Boyle & Gates

[57] ABSTRACT

Weights for road markers and signs having a laminate structure of a plurality of side walls of discarded vehicle tires assembled and fastened in a stacked configuration and slidable over the road markers and sign frames. The weight of the laminate structure stabilizes the road marker or sign to prevent the marker or sign from being blown or knocked over on its side.

4 Claims, 2 Drawing Sheets

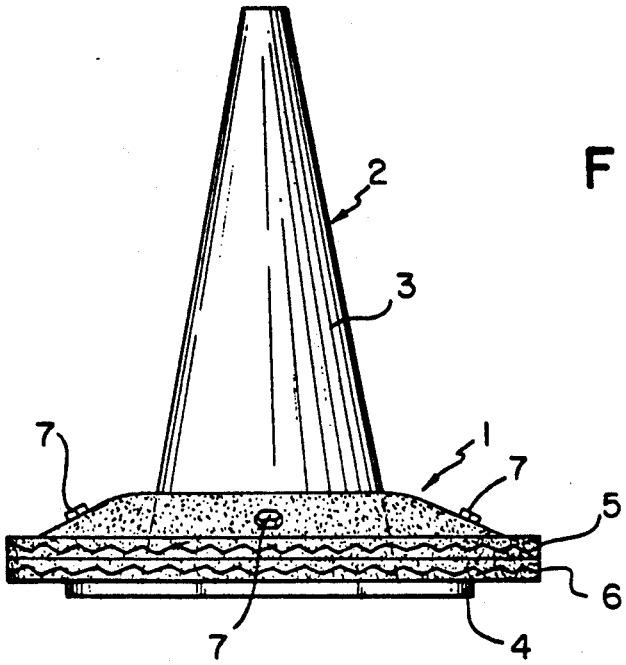
Fig. 1
Fig. 2
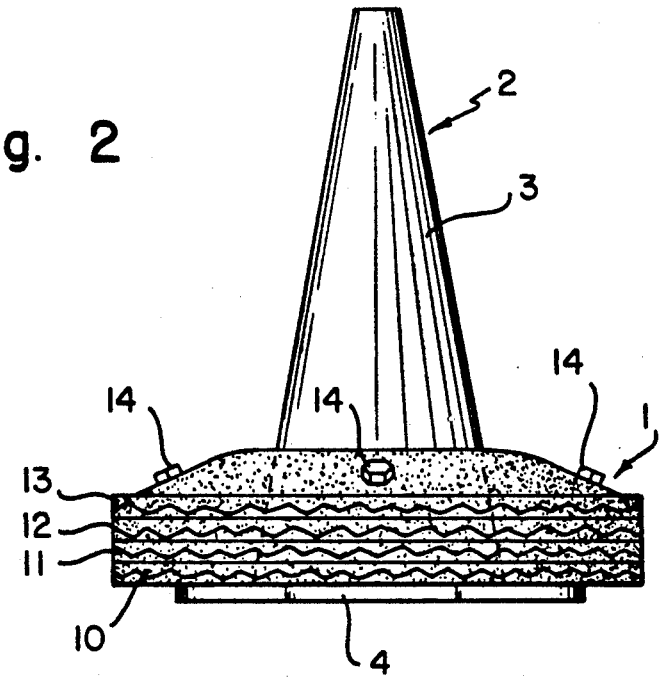

WEIGHTS FOR ROAD MARKERS

BACKGROUND OF THE INVENTION

Road markers or signs are utilized in general on construction sites and roadsides to direct vehicular traffic around road obstructions. The traffic markers typically are comprised of a molded, brightly colored conical upright having an integral base portion for supporting the conical upright on the ground, and the signs are supported on the ground by wooden frames. These markers and sign frames are somewhat lightweight and can be easily blown or knocked over by the passing vehicles. Most often sand bags are employed for holding the markers or signs from being knocked over.

While it is known to provide conical road markers with weighted base plates as disclosed in U.S. Pat. Nos. 3,099,244, dated Jul. 30, 1963, and 4,925,334, dated May 15, 1990, these base plates have been fabricated from material used for the first time. In order to prevent the decimation of our raw materials, there is a concerted effort today to either recycle or find a use for old or worn out products, such as discarded vehicle tires.

The disposal of millions of discarded vehicle tires has become a paramount problem. The most efficient method of disposal is by burning; however, the burning of tires is prohibited in practically every community by antipollution laws. Some discarded tires are ground up and the rubber is reclaimed for use in new rubber products or used in a paving composition.

In an attempt to provide a use for old or worn out vehicle tires, it has been proposed to make receptacles or containers for plants, as disclosed in U.S. Pat. Nos. 3,621,611, dated Nov. 23, 1971, and 5,050,342, dated Sept. 24, 1991. It has also been proposed to fabricate traffic markers and road barricades from the side walls of discarded vehicle tires, as disclosed in U.S. Pat. Nos. 3,692,281 and 4,021,020.

SUMMARY OF THE INVENTION

After considerable research and experimentation, the instant invention provides yet another use for discarded vehicle tires, and comprises, essentially, a laminate structure of a plurality of side walls of discarded vehicle tires assembled and fastened in a stacked configuration to obtain desirable weight and slidable over the cone portion of a conventional conical road marker and supported on the base of the cone, whereby the weight of the laminate structure stabilizes the base of the cone, to thereby prevent the marker from being knocked over or blown on its side. The weight of the laminate structure is determined by the number of side walls in the stack.

BRIEF DESCRIPTION OF THE DRAWINGS

FIG. 1 is a side elevational view of the weighted road marker of the present invention, wherein the weight consists, of two discarded tire side walls fastened together;

FIG. 2 is a side elevational view of the weighted road marker of the present invention, wherein the weight consists of four discarded tire side walls fastened together;

DESCRIPTION OF THE PREFERRED EMBODIMENT

Figure 3:
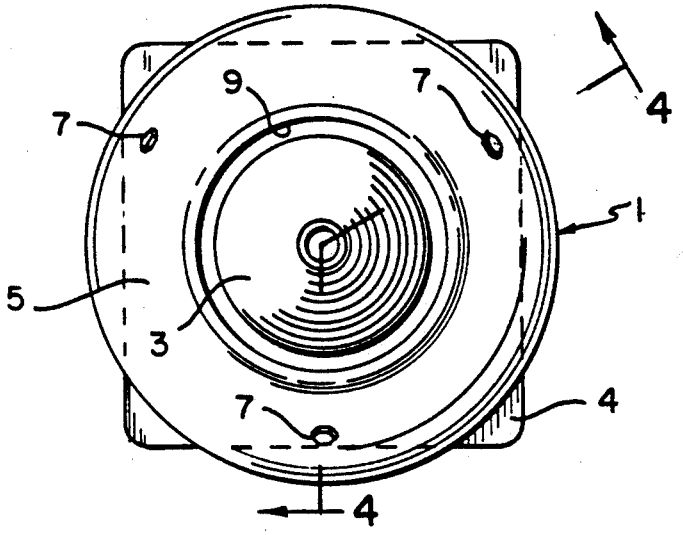
FIG. 3 is a top plan view of the weighted road marker shown in FIG. 1.
Figure 4:
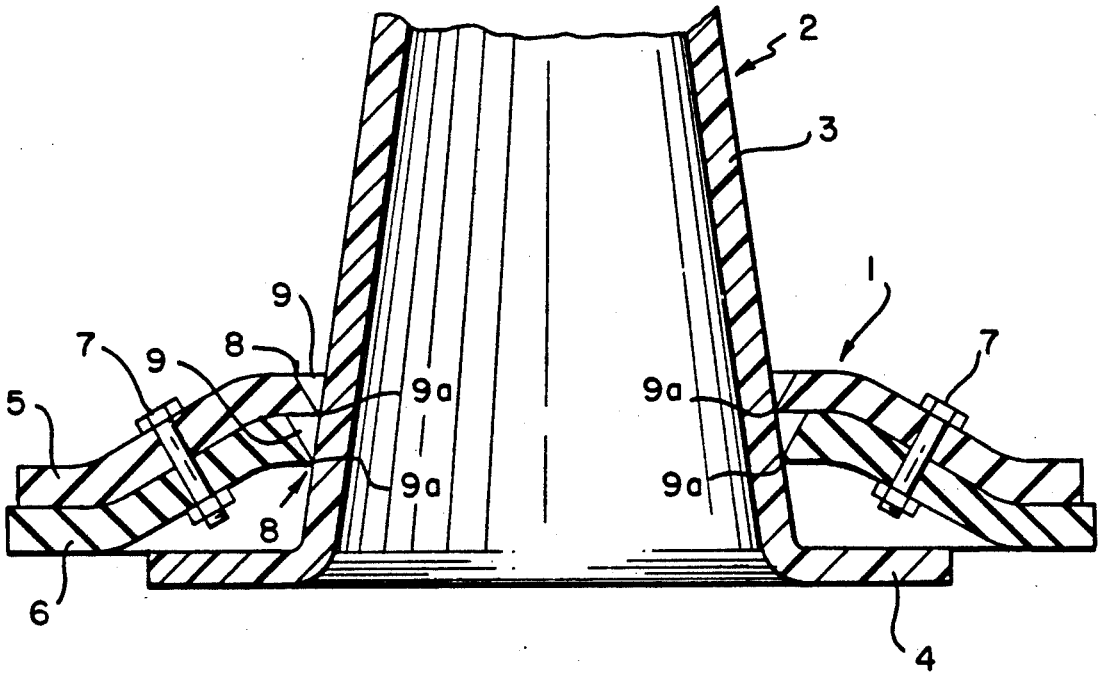
FIG. 4 is a fragmentary sectional view taken along line 4—4 of FIG. 3.

Referring to the drawings and more particularly to FIGS. 1, 3 and 4, the weight 1 of the present invention is adapted to be removably mounted on a conventional traffic marker 2 comprising a molded, brightly colored conical upright portion 3 having an integral base portion 4 for supporting the conical upright portion 3 on the ground.

In the embodiment shown in FIGS. 1 and 4, the weight 1 comprises a pair of discarded vehicle tire side walls 5 and 6 secured in face-to-face relationship by suitable fasteners such as nut and bolt assemblies 7. As will be seen in FIG. 4, the bead portions 8 of side walls 5 and 6 are aligned to provide a through opening 9 and cut at an angle to provide circular edges 9*a* for gripping the side wall of the conical upright portion 3, whereby the weight is releasably connected to the marker.

The markers 2 are usually stored in a stacked, nested relationship as are the weights 1. In use, the markers are placed on the road where desired, and a weight 1 is placed over the conical portion 3 and allowed to drop to the position shown in FIG. 4. When it is desired to remove the weighted marker from the road, the weight is manually lifted off the base 4 and conical portion 3 and stored in a convenient location and the markers are then removed from the road and stored in a stacked, nested relationship; however, the tire weights and cones can be stacked without removal from the road marker cone.

While the embodiment of the weight shown in FIGS. 1, 3 and 4 consists of a laminate structure having a pair of discarded tire side walls 5 and 6, where it is desired to use a heavier weight to prevent the marker from being blown over in situations where the marker is to be used on roads or highways having high speed vehicular traffic, additional layers of side walls can be employed as shown in FIG. 2 wherein four side walls 10, 11, 12 and 13 are positioned in face-to-face stacked relationship and fastened together as at 14.

From the above description, it will be readily appreciated by those skilled in the art that this invention provides a new use for worn, discarded tires and fulfills a long need for providing a simple weight for stabilizing road markers.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A weight for a road marker comprising, a plurality of discarded tire side walls, said side walls being stacked in face-to-face relationship, means fastening the tire side walls in said stacked relationship to provide a laminate structure, said road marker having a base portion for supporting the road marker on the ground, said laminate structure being mounted on said base, to thereby stabilize the road marker against being displaced on its side.

2. A weight for a road marker according to claim 1, wherein said road marker includes an upright portion integral with the base portion, the bead portions of the stacked side walls being aligned to provide a through opening, the upright portion of the marker extending through said opening.

3. A weight for a road marker according to claim 2, wherein the upright portion comprises a conical portion, the bead portions of the side walls being cut at an angle to thereby provide circular edges gripping the side wall of the conical portion.

4. A weight for a road marker according to claim 1, wherein the fastening means comprises a plurality of nut and bolt assemblies extending through the faces of said stack of side walls.

* * * * *